US006292950B1

(12) United States Patent
Mentone

(10) Patent No.: US 6,292,950 B1
(45) Date of Patent: Sep. 25, 2001

(54) ADJUSTABLE GARMENT

(76) Inventor: Gina Mentone, 71 Lefferts Pl. Apt. 7, Brooklyn, NY (US) 11238

( * ) Notice: Subject to any disclaimer, the term of this patent is extended or adjusted under 35 U.S.C. 154(b) by 0 days.

(21) Appl. No.: 09/597,132

(22) Filed: Jun. 20, 2000

(51) Int. Cl.[7] ..... A41D 1/06
(52) U.S. Cl. ..... 2/236; 2/221
(58) Field of Search ..... 2/220, 76, 221, 2/69, 236, 237, 227, 228, 238, 211, 114, 912, 914, 919, 920, 213, 270

(56) References Cited

U.S. PATENT DOCUMENTS

| | | | | |
|---|---|---|---|---|
| 701,252 | * | 5/1902 | Bandler | 2/236 |
| 2,443,085 | * | 6/1948 | Sachs | 2/221 |
| 2,581,627 | * | 1/1952 | Bubb | 2/236 |
| 2,755,481 | * | 7/1956 | Cantil | 2/236 |
| 3,040,331 | * | 6/1962 | Iampkowitz | 2/236 |
| 3,106,717 | * | 10/1963 | Cuvin | 2/221 |
| 3,812,862 | | 5/1974 | Bernstein . | |
| 4,677,699 | | 7/1987 | Barabe . | |
| 4,893,358 | * | 1/1990 | Bice, Jr. | 2/221 |
| 5,033,125 | | 7/1991 | de la Villefromoy et al. . | |
| 5,566,393 | | 10/1996 | Best . | |

* cited by examiner

*Primary Examiner*—Gloria M. Hale
(74) *Attorney, Agent, or Firm*—Dicke, Billig & Czaja, P.A.

(57) ABSTRACT

A garment having an adjustable waist is provided. The adjustable garment includes a waist portion and an adjustment device. The adjustment device is disposed along a surface of the waist portion and includes a central receiving element and opposing fastening elements. The opposing fastening elements are positioned laterally along the waist portion at opposite sides thereof. Furthermore, the opposing fastening elements are spaced from the central receiving element and are configured to be selectively secured to the central receiving element. With this configuration, a user can quickly and conveniently alter a position of the opposing fastening elements relative to one another, and maintain this position via attachment to the central receiving element. As a result, the area or circumference defined by the waist portion is readily adjustable.

20 Claims, 7 Drawing Sheets

ADJUSTABLE GARMENT

THE FIELD OF THE INVENTION

The present invention generally relates to garments, and more particularly to adjustable garments such as those having an adjustable waist.

BACKGROUND OF THE INVENTION

Adjustable garments, or garments with means for adjusting some dimension of the garment, are more convenient, economical, and better fitting than fixed-size garments when size of the garment wearer varies. Garments having waist portions are well suited for providing adjustment means. Waist measurements frequently vary between individuals, even those of the same height, and can change over time for a single individual.

One application for an adjustable waist garment is an employer providing uniforms to a number of employees. The capability to fit a wide number of employees of varying sizes from a small selection of adjustable-size garments provides the aforementioned advantages to the employer in maintaining a relatively smaller inventory of uniforms. Employees benefit too. Uniform adjustments provide a closer fit when a full selection of custom garment sizes are unavailable. Similarly, clothing retailers benefit from adjustable garments, since they also may need only stock a reduced number of adjustable garment sizes to accommodate a broad range of customer sizes.

Another, more common application where adjustable garment utility is evident, is for the case when size of an individual wearer varies over time. Waist size varies due to weight gain or loss, exercise, maternity or body proportion changes associated with growth, maturing or aging. Waist size can fluctuate, increasing or decreasing over time. Even though an individual's size remains constant, an adjustable garment provides convenience in donning and removing the garment. The garment adjustment means is expanded for changing the garment and reduced for wearing the garment thus providing a closer fit. An adjustable garment can also be adjusted to counteract garment shrinkage or stretching, such as after cleaning.

Numerous methods have conventionally been used to provide for waist adjustment, including buttons, elastic, straps, drawstrings, ties, belts and removable waist padding. U.S. Pat. No. 4,893,358 to Bice, herein incorporated by reference, sets forth numerous examples of conventional garment waist adjustment methods and their shortcomings.

In one conventional embodiment, a garment having a waist adjustment feature is accomplished by forming (sewing) one or more foldable members from excess waist material. These discrete foldable members are subsequently overlapped back around the waist, in an unflattering and very noticeable manner. Each discrete foldable member is secured by a discrete pair of mated interlocking hook and loop fasteners (commonly known as Velcro®).

The conventional foldable member is formed from a double layer of waist fabric sewn together as a winglet along with one side of the hook and loop fastener pair. In constructing the discrete foldable member, a preferred waist material fold angle is fixed by sewing into the shape of the foldable member, thus defining a most preferred waist size. The fabric material near the foldable member may not lie naturally for waist size adjustments other than the most preferred waist size, making the fold more noticeable. The sewn foldable members (winglets) also prohibit full waist expansion of conventionally adjustable garments.

Conventional waist adjustment methods typically favor function over form, i.e., ease of adjustment over garment appearance. However, an important source of garment utility is also derived from appearance of the garment when worn. Conventional garment adjustment means are typically located for ease of operation of the adjustment means, making the adjustment features visible to others, either directly or because the adjustment creates unsightly bunches of excess garment material in the reduced-size configuration.

In view of the above, there is a need for a garment having a continuously adjustable waist, capable of expansion and contraction to accommodate the varying needs of the wearer. There is a further need for a garment that provides an elegantly simple design incorporating ease of adjustment with economy of construction, versatile adjustment range and a less noticeable adjustment means than currently available in conventional adjustable waist garments.

SUMMARY OF THE INVENTION

One aspect of the present invention relates to an adjustable garment. The adjustable garment includes a waist portion and an adjustment device. The adjustment device is disposed along a surface of the waist portion and includes a central receiving element and opposing fastening elements. The opposing fastening elements are positioned laterally along the waist portion at opposite sides of the central receiving element. More particularly, each of the opposing fastening elements are spaced from the central receiving element and are configured to be selectively secured to the central receiving element. With this configuration, by securing the opposing fastening elements to the central receiving element, an available area or circumference of the waist portion can be altered. In one preferred embodiment, a hook-and-loop material is used for the central receiving element and the opposing fastening elements. In another preferred embodiment, the opposing fastening elements are equidistantly spaced from the central receiving element so as to provide a uniform aesthetic appearance.

Another aspect of the present invention relates to an adjustable garment having a waist portion. The adjustable garment comprises an opposing pair of folds and an adjustment device. The opposing pair of folds are formed from excess material of the waist portion, with each pair being folded back toward one another, so as to reduce an area (or circumference) defined by the waist portion. The adjustment device is secured to the waist portion for selectively maintaining the opposing pair of folds. In this regard, the adjustment device includes a central receiving element and opposing fastening elements. With this configuration, the opposing fastening elements are spaced from the central receiving element and are configured to be selectively secured to the central receiving element. Thus, by detaching, repositioning and reattaching the opposing fastening elements relative to the central receiving element, the length of each of the opposing pair of folds can be selectively adjusted.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
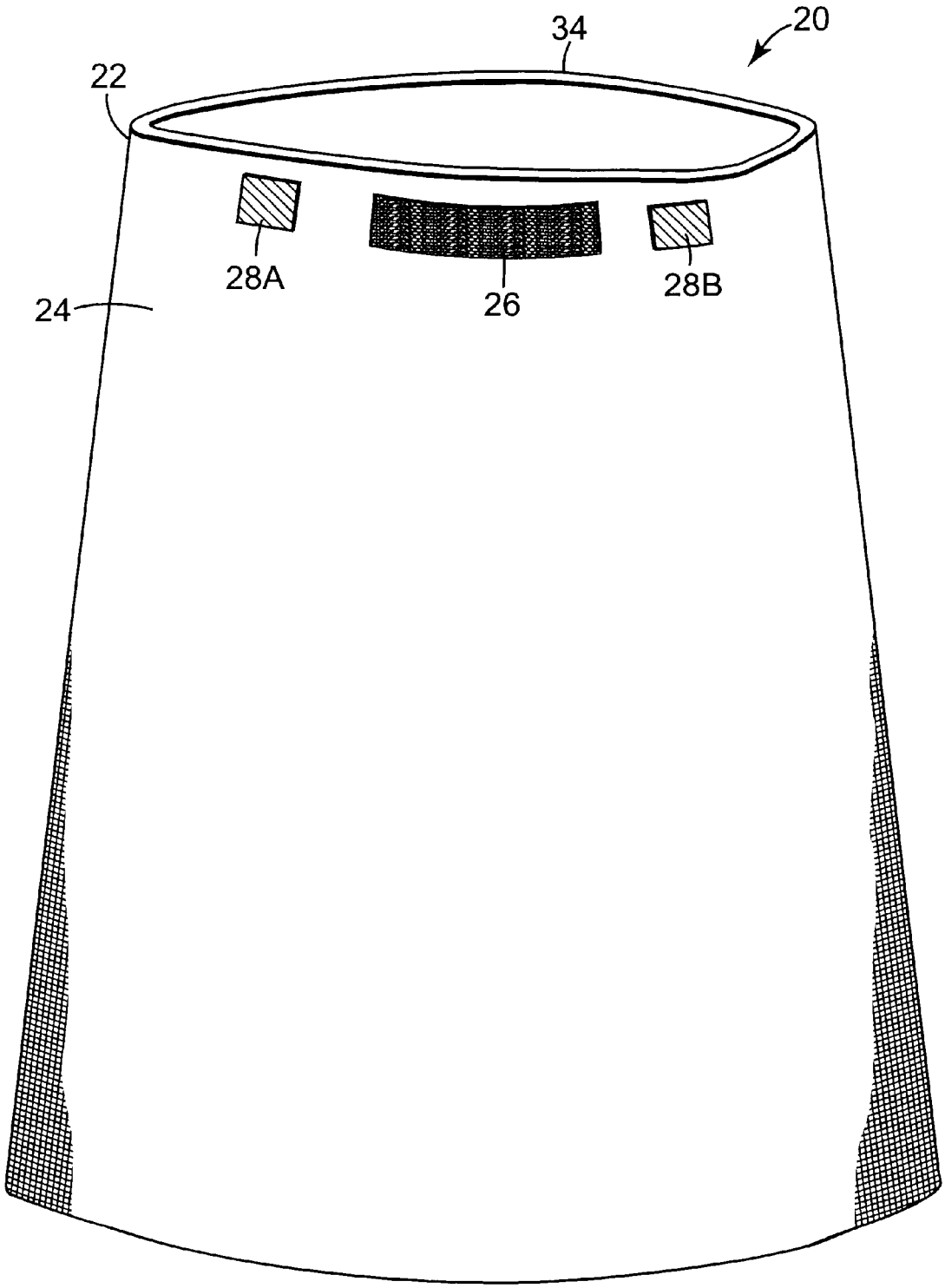
FIG. 1 is a perspective view of a dress garment of the present invention having an externally mounted adjustment means in an expanded configuration.

FIG. 1 illustrates a preferred embodiment of an adjustable garment of the present invention in a dress configuration, generally indicated at 20. The present invention may also be implemented in skirt, skort, jumper, pant, short, jumpsuit, maternity, smock, shirt, blouse and similar configurations having a portion that encircles a wearer's waist.

Garment 20 has a waist portion 22 with an exterior surface 24. Attached to exterior surface 24 is at least one adjustment device. By way of example, a single adjustment device is shown attached to exterior surface 24 in FIG. 1. Garment 20 is shown in an expanded, or maximum waist size, condition. In a preferred embodiment, the adjustment device is a set of complementary hook and loop fasteners, such as Velcro®. The adjustment device includes a single central receiving element 26 and an opposing pair of fastening elements 28A, 28B. Preferably, the central receiving element 26 includes a plurality of loops, and therefore can be referred to as a loop receiving element 26. Conversely, the opposing fastening elements 28A, 28B each includes a plurality of corresponding hooks, and can therefore be referred to as hook fastening elements 28A and 28B. Alternatively, materials for the elements 26, 28A and 28B can be reversed such that the central receiving 26 includes a plurality of hooks, and fastening elements 28A, 28B include a plurality of loops. Regardless, opposing fastening elements 28A, 28B are slightly space from, and disposed at opposite sides of, central receiving element 26.

Figure 4A:
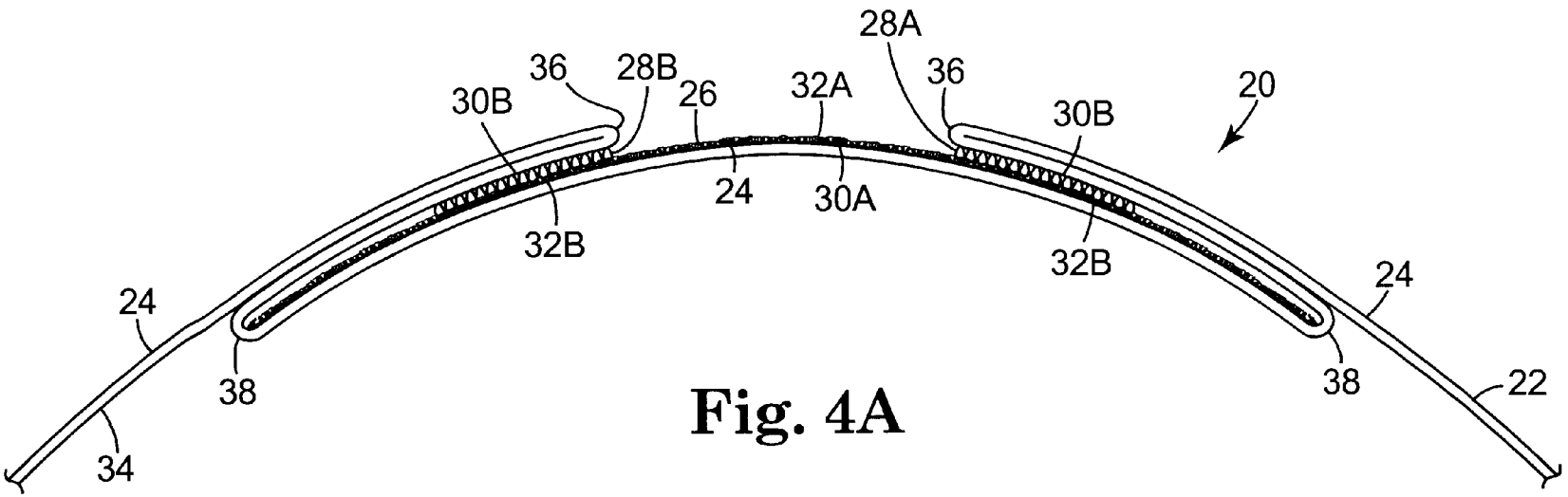
FIG. 4A is a top view of a dress garment of the present invention having an externally mounted adjustment means in a first reduced-waist-size configuration.
Figure 4B:
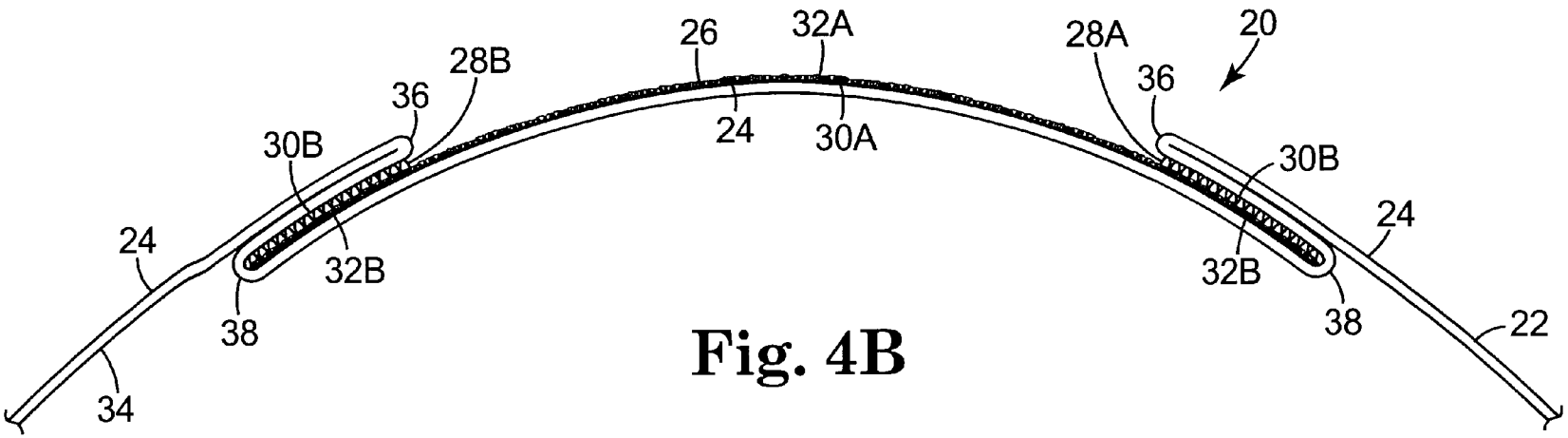
FIG. 4B is a top view of a dress garment of the present invention having an externally mounted adjustment means in a second reduced-waist-size configuration.

With further reference to FIGS. 4A and 4B, loop fastening element 26 has a smooth fabric surface 30A and a mating surface 32A. Hook fastening elements 28A and 28B each also have a smooth fabric surface 30B and a mating surface 32B. Mating surface 32A of receiving element 26 comprises a plurality of loops extending from the smooth fabric surface 30A. Mating surface 32B of hook fastening element 28A comprises a plurality of hooks extending from the smooth fabric surface 30B. Hook fastening element 28B is constructed identically to hook fastening element 28A. When mating surface 32B of hook fastening element 28A or 28B is placed in contact with mating surface 32A of receiving element 26, the plurality of hooks of hook fastening element 28A engage and interlock the plurality of loops of receiving element 26. A separable bond, well known by those skilled in the art, is thus made to retain hook fastening element 28A in contiguous engagement with receiving element 26.

Receiving element and hook fastening elements 28A and 28B are permanently attached to waist portion 22 such that the respective fastening element mating surface faces away from exterior surface 24. Receiving element 26 and hook fastening elements 28A and 28B are affixed to exterior surface 24 of garment 20. Hook fastening elements 28A and 28B and receiving element 26 are secured to exterior surface 24 by sewing, stitching, bonding or other known method. Receiving element 26 and hook fastening elements 28A and 28B are secured exterior surface 24 in such a manner as to allow garment 20 to expand fully, as shown in FIG. 1. For example, when attached by stitching, the stitching extends through only one layer of underlying garment 20 fabric.

In a preferred embodiment, receiving element 26 is attached slightly below a top edge 34 of garment 20 and located laterally along waist portion 22 adjacent the front-center portion of garment 20 as worn. First hook fastening element 28A is positioned laterally along waist portion 22 to one side of receiving element 26. Second fastening element 28B is positioned laterally along waist portion 22 to the other side of receiving element 26, opposite first hook fastening element 28A. Receiving element 26 is thusly located between hook fastening elements 28A and 28B. In an alternative embodiment, the set of adjustable fastening elements comprises one hook fastening element located between two loop fastening elements (i.e., hook fastening elements and loop fastening elements are interchanged).

Waist portion 22 of garment 20 is adjustable within a range. The distance between receiving element 26 and each hook fastening element, 28A and 28B, is determined by the range of garment adjustability desired. The greater the adjustability range desired, the greater the lateral distance between receiving element 26 and each of hook fastening elements, 28A and 28B.

In an alternative embodiment, the set of adjustable fastening elements is located laterally along waist portion 22 adjacent the rear-center portion of garment 20 as worn. It is within the scope of the present invention to locate the set of adjustment fastening elements anywhere along waist portion 22 as determined by a particular garment's style and function, including locating the set of adjustment fastening elements laterally along waist portion 22 adjacent the left or right hip portion of garment 20 as worn. In a further embodiment, two sets of adjustment fastening elements are located laterally along waist portion 22, one adjacent the front-center portion and one adjacent the rear-center portion of garment 20's waist portion 22 as worn. In a further embodiment of the present invention, multiple sets of adjustment fastening elements are located at multiple locations along waist portion 22 including the left and/or right sides of garment 20.

Figure 2:
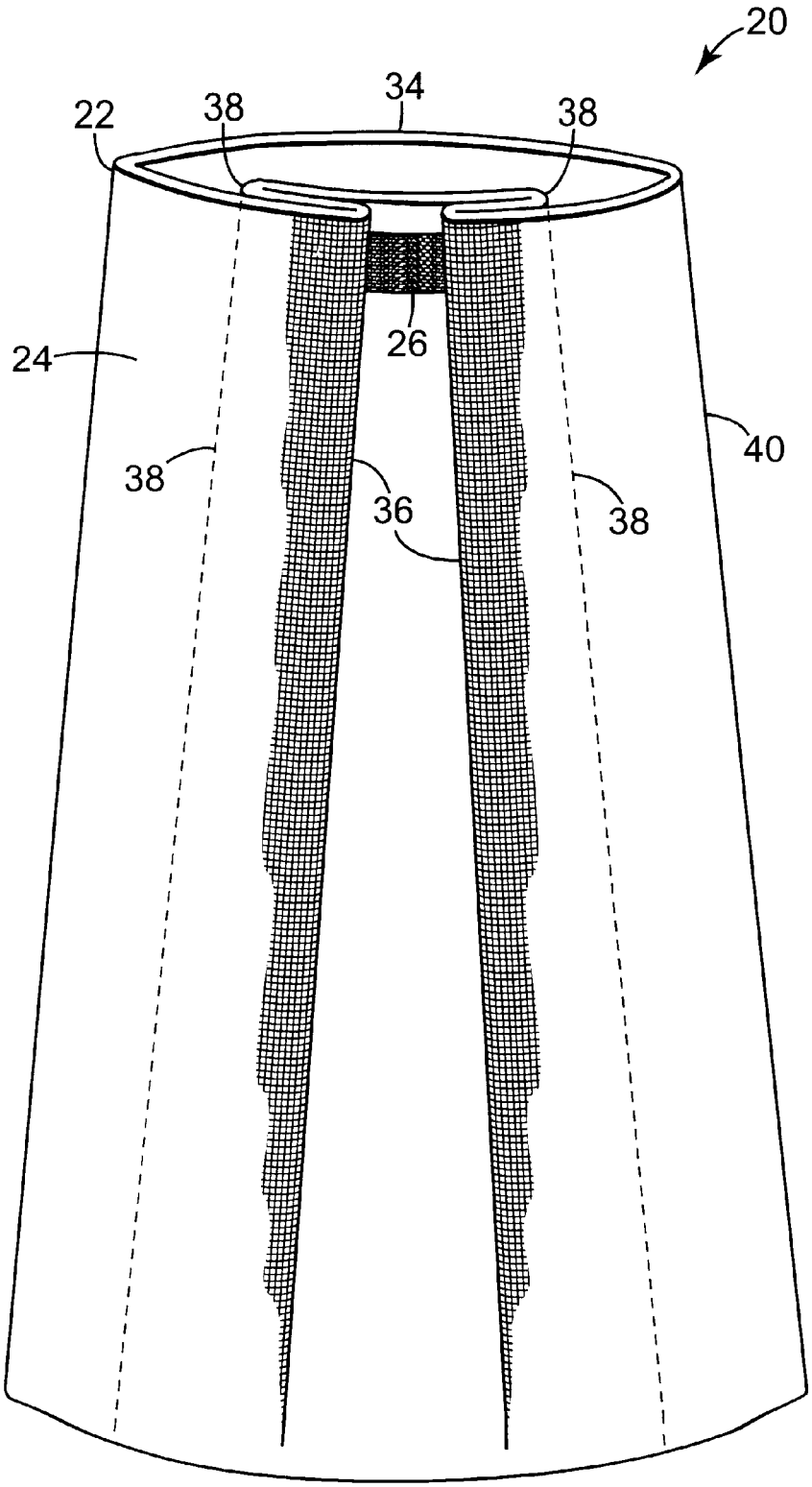
FIG. 2 is a perspective view of the dress garment of FIG. 1 in a reduced-waist-size configuration.

Referring now to FIG. 2, waist portion 22 of garment 20 is adjusted by moving hook fastening elements 28A and 28B toward receiving element 26, thereby folding along with excess waist portion 22 material back along waist portion 22. Hook fastening elements 28A and 28B are moved toward each other and mating surfaces 32B of hook fastening elements 28A and 28B are placed into contiguous engagement with mating surface 32A of receiving element 26 as shown in FIG. 2. In this manner, each of hook fastening elements 28A and 28B are removably affixed to receiving element 26.

The above relationship creates four folds in garment 20, including two external folds 36 and two internal folds 38. In a preferred embodiment, hook fastening elements 28A and 28B are positioned in contact with receiving element 26 such that external folds 36 are symmetrically located with respect to the center-front of garment 20. Hook fastening elements, 28A and 28B, are each preferably affixed to receiving element 26 approximately equidistant from the ends of receiving element 26. External folds 36 and internal folds 38 are oriented approximately parallel to the peripheral edge 40 of garment 20. Affixed in this manner, hook fastening elements 28A and 28B are hidden from view by external folds 36. Some, or all, of receiving element 26 is also covered by external fold 36.

Figure 3:
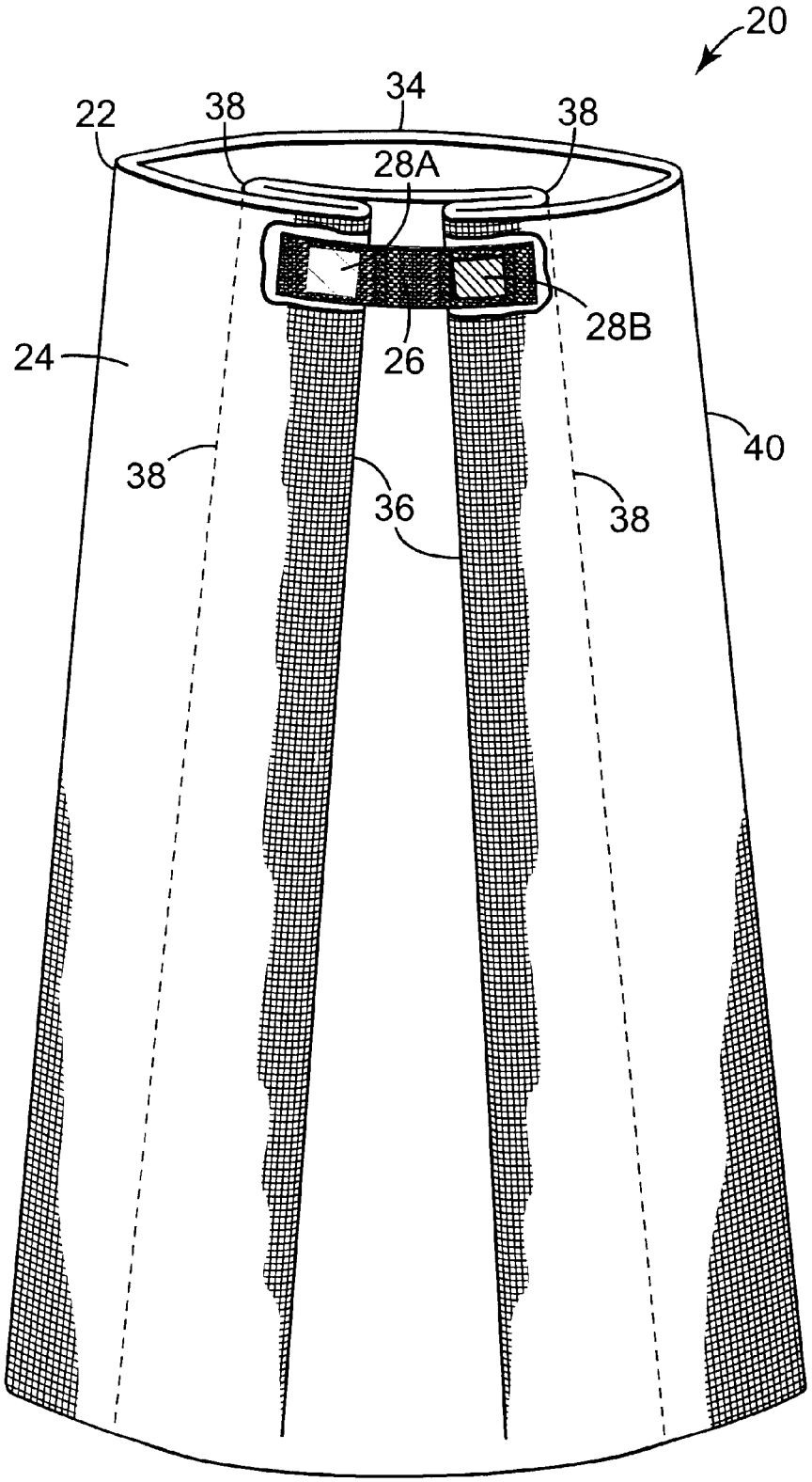
FIG. 3 is a cutaway perspective view of the dress garment of FIG. 2 to show the relative location of the adjustment means.

FIG. 3 illustrates a cut-away perspective view of garment 20 of FIG. 2. The relative location of receiving element 26 and hook fastening elements 28A and 28B are shown. Waist portion 22 diameter is varied by placing hook fastening elements 28A and 28B closer together upon receiving element 26 for smaller waist portion 22 size or further apart for larger waist portion 22 size.

FIGS. 4A and 4B show top views of garment 20, illustrating positioning of hook fastening elements 28A and 28B to receiving element 26. Hook fastening elements 28A and 28B are located closer together and near the center of receiving element 26 in FIG. 4A providing a smaller waist portion 22 size. In FIG. 4B receiving elements 28A and 28B are positioned further apart, nearer the ends of receiving element 26, providing a larger waist portion 22 size.

The extent to which external folds 36 are wrapped around the waist of the wearer determines waist portion 22's circumferential dimension. Those skilled in the art will recognize that the circumferential dimension of waist portion 22 decreases as hook fastening elements 28A and 28B are moved towards each other along receiving element 26. Likewise, the circumferential dimension of waist portion 22 increases as hook fastening elements 28A and 28B are moved further from each other along receiving element 26. A maximum circumferential waist portion 22 dimension is achieved when hook fastening elements 28A and 28B and receiving element 26 are not in contact with each other, as is illustrated in FIG. 1. Similarly, a minimum circumferential waist portion 22 dimension is achieved when hook fastening elements 28A and 28B are affixed adjacent to each other and in contact with loop fastening element 26.

Hook fastening elements 28A and 28B and receiving element 26 are preferably flexible fabric-backed fastening elements such that their shape conforms to the wearer. The surface area of hook fastening elements 28A and 28B are sufficiently large enough to maintain adhesion of the hook and loop fastening elements during garment use. Within a set of adjustable fastening elements, loop fastening element surface area is preferably equal to or greater than the combined surface area of the hook fastening elements and loop fastening element length is preferably equal to or greater than the combined length of the hook fastening elements.

Figure 5:
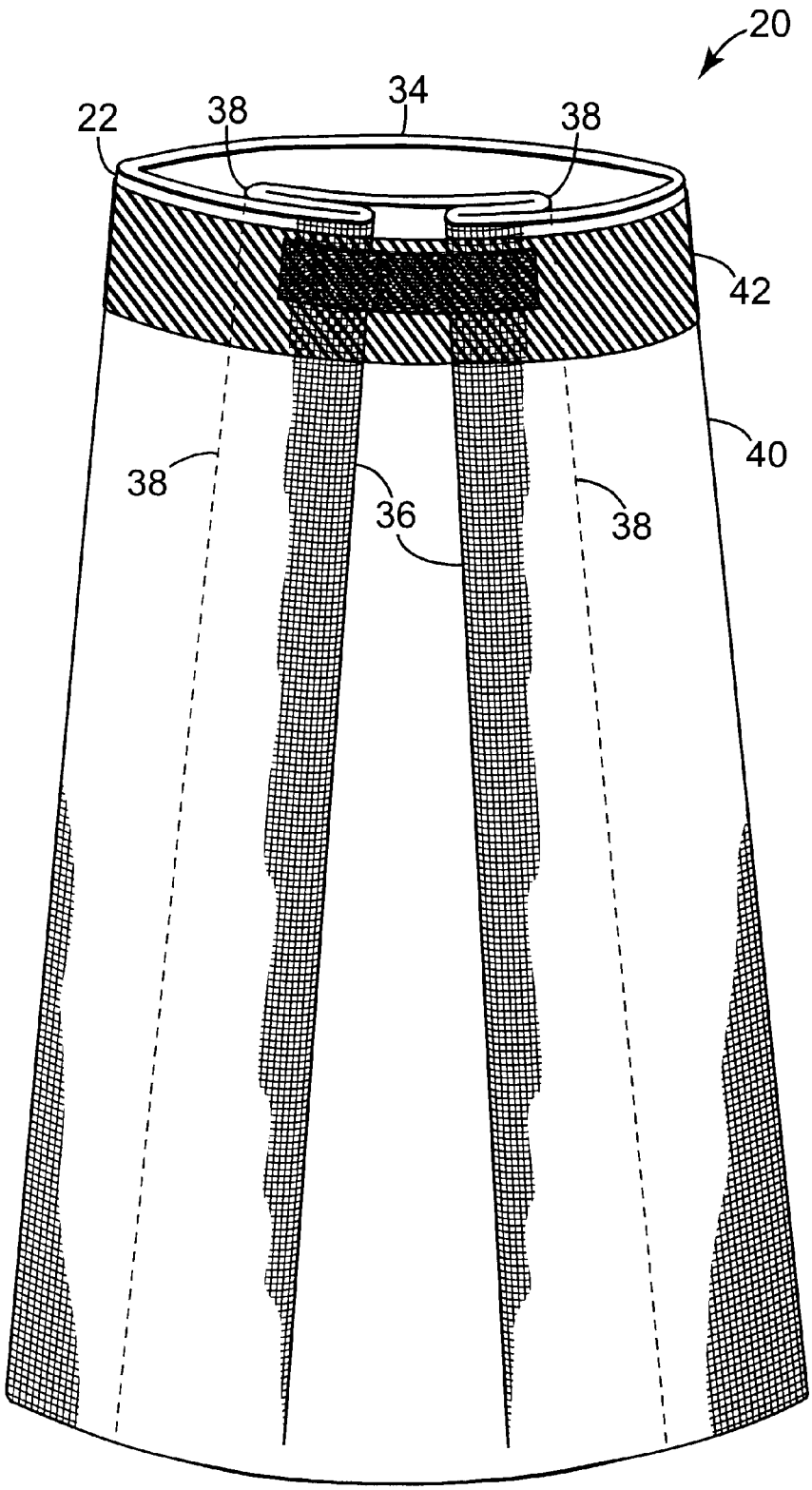
FIG. 5 is a perspective view of the dress garment of FIG. 2 shown with the adjustment means concealed.

In one preferred embodiment a belt 42 around waist portion 22 of garment 20 to further conceal receiving element 26, as depicted in FIG. 5. Although external folds 36 conceal both hook fastening elements, 28A and 28B, and some or all of receiving element 26, complete concealment of receiving element 26 is achieved by belt 42. Belt 42 extends completely around waist portion 22 of garment 20. The vertical dimension or width of belt 42 is determined by style considerations and overall garment 20 dimensions. At a minimum, the vertical width of belt 42 is greater than the vertical width of receiving element 26 so as to completely conceal the portion of receiving element 26 not concealed by external folds 36. Belt 34 preferably resides below top edge 34. In an alternative embodiment, belt 42 extends over and above top edge 34 to conceal top edge 34. Belt 42 aids in maintaining contiguous engagement between hook fastening elements, 28A and 28B, and loop fastening element 26. Belt 42 may be made variable using complementary hook and loop fasteners at each end or other known methods. Further, belt 42 can include hook-type material (hidden in FIG. 5) extending along a portion of an inner surface thereof for selective attachment to portions of the loop fastening element 20 otherwise left exposed.

Figure 6:
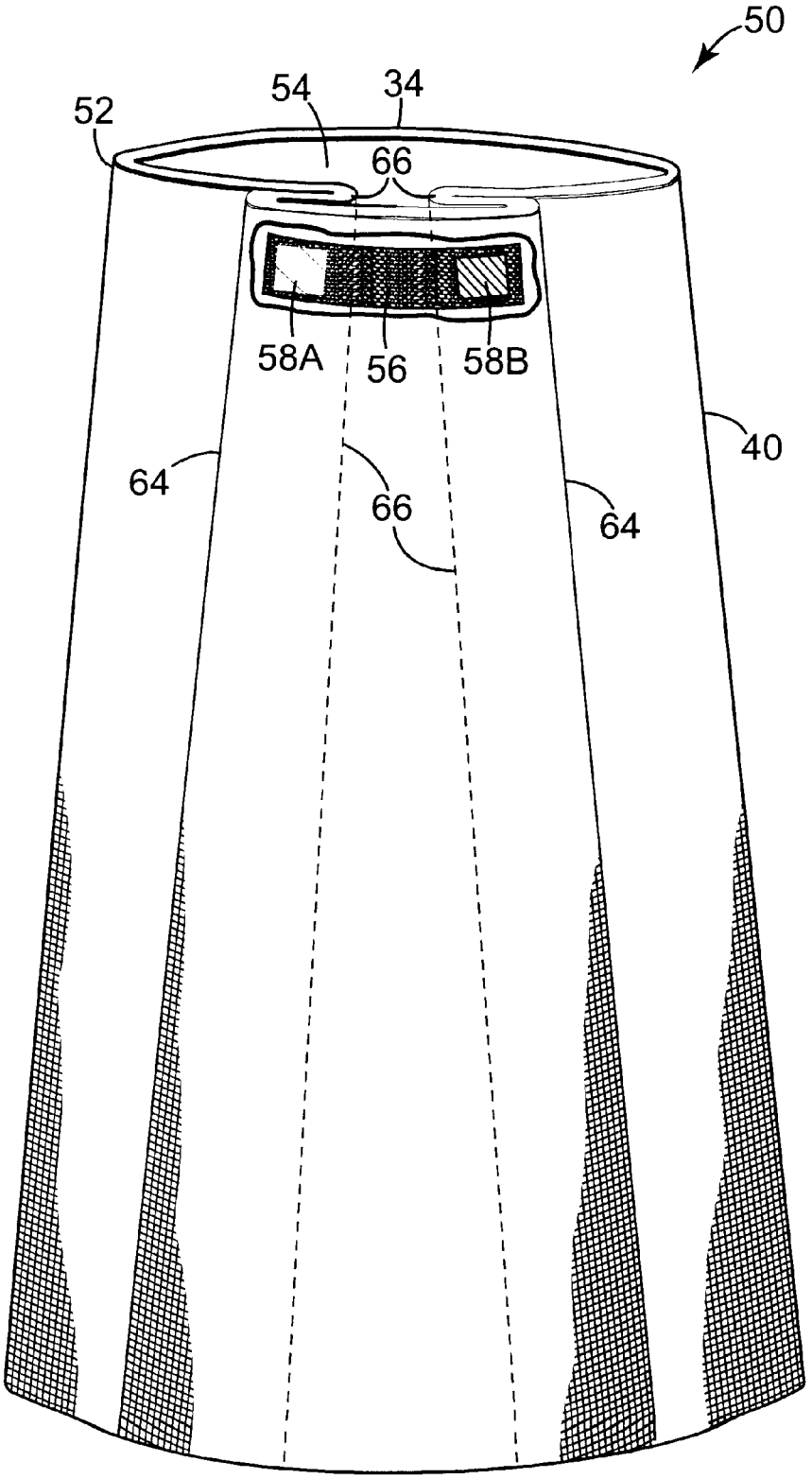
FIG. 6 is a perspective view of an alternative embodiment of the dress garment of the present invention having an internally mounted adjustment means shown in a reduced-waist-size configuration.

FIG. 6 illustrates a cutaway view of an alternative embodiment garment 50 including an attachment device in accordance with the present invention. Garment 50 is preferably a dress having a waist portion 52 with an interior surface 54. Loop fastening element 56 and hook fastening elements 58A and 58B are affixed to interior surface 54 of garment 50. Loop fastening element 56 is affixed to the interior surface 54 of garment 50 such that mating surface 60A of loop fastening element 56 faces away from interior surface 54. Similarly, hook fastening elements 58A and 58B are affixed to interior surface 54 of garment 50 such that mating surfaces 60B of hook elements 58A and 58B face away from interior surface 54.

Waist portion 52 of garment 50 is adjusted by folding mating surfaces 60B of hook fastening elements 58A and 58B back into contact with mating surface 60A of loop fastening element 56 as shown in FIG. 6.

Figure 7A:
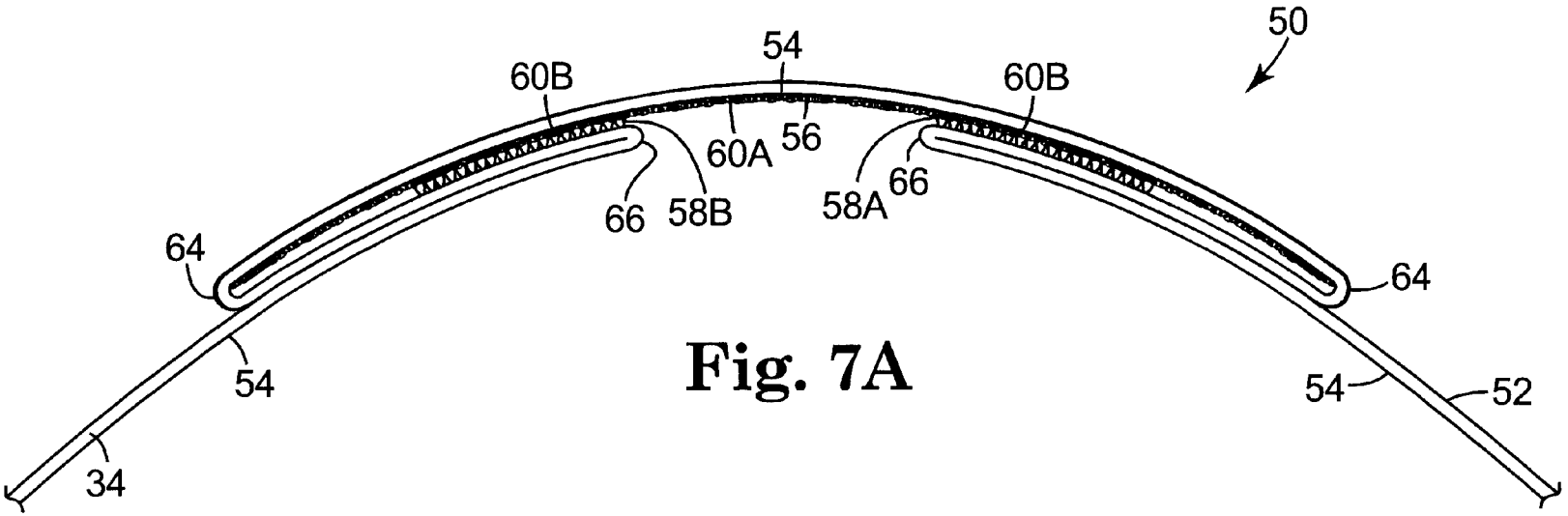
FIG. 7A is a top view of an alternative embodiment of the dress garment of the present invention having an internally mounted adjustment means in a first reduced-waist-size configuration.
Figure 7B:
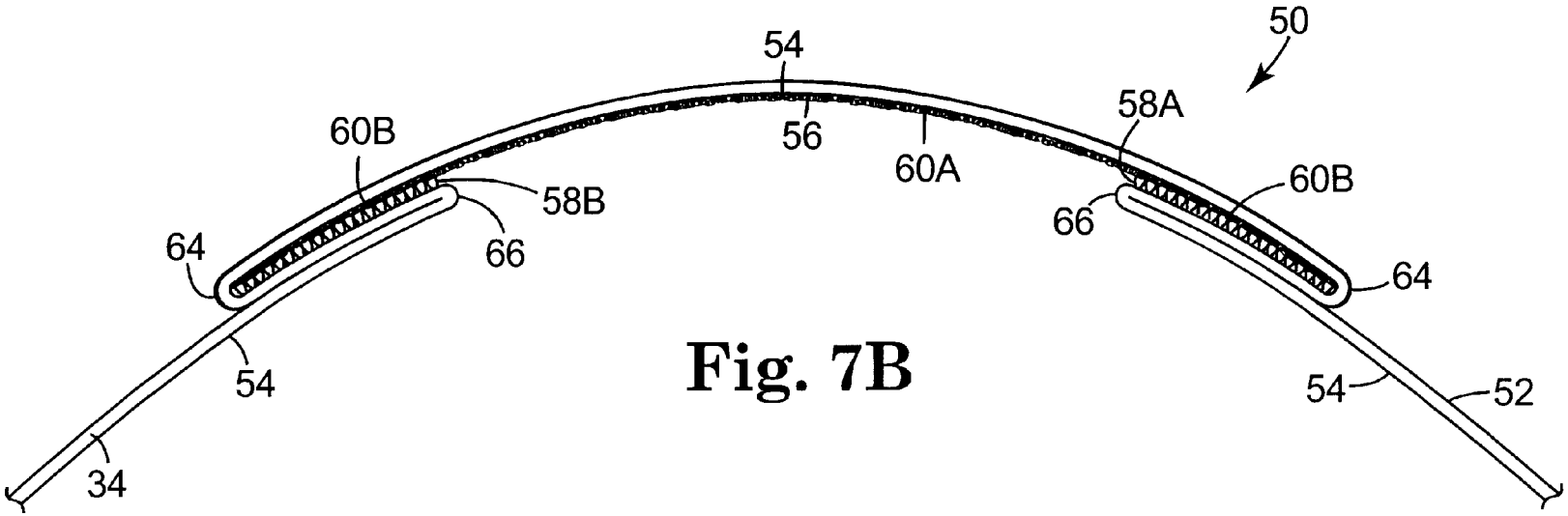
FIG. 7B is a top view of an alternative embodiment of the dress garment of the present invention having an internally mounted adjustment means in a second reduced-waist-size configuration.

FIGS. 7A and 7B illustrate top views of garment 50. Those skilled in the art will appreciate the distinctions of garment construction between the alternative embodiment of the present invention illustrated in FIGS. 7A and 7B from that of the preferred embodiment of the present invention illustrated in FIGS. 4A and 4B. As can be seen from FIG. 7A, loop fastening element 56 is affixed to interior surface 54 of garment 50. Exterior surface 54 of garment 50 completely conceals loop fastening element 56 and hook fastening elements 58A and 58B. A belt (i.e., 42 in FIG. 4) is not required to conceal loop fastening element 56 and hook fastening elements 58A and 58B in the alternative embodiment shown in FIG. 6 since adjustment fastening elements are affixed interior surface 54 of waist portion 52. Notably, while the materials used for the loop fastening element 56 and the hook fastening elements 58A and 58B can be reversed, in the preferred embodiment, because the loop fastening element 56 is in contact with the user's body, loop material (as opposed to hook material) is employed, as loop material is less abrasive (and therefore more comfortable) than hook material.

Those skilled in the art will understand that other features and operation of the present invention alternatively embodied in garment 50 are similar to those embodied in the preferred embodiment of garment 20 including circumferential location of the adjustable fastening elements along waist portion 52 and adjustment of waist portion 52 dimension.

Additional optional features of the present invention include addition of a waist closure device (not shown)

incorporated into waist portion 22. The waist closure device is accomplished by known methods such as a zipper, buttons, snaps, or overlapping complementary hook and loop apparatus. Addition of a waist closure device allows the wearer to adjust the garment and fix the position of the adjustable fastening elements before donning the garment. Optionally, an expandable member, such as by elastic, is provided by known methods as part of waist portion 22. Optional methods of concealing adjustable fastening elements such as by providing a garment lining or fabric cover over the adjustable fastening elements, is provided in alternative embodiments of the present invention.

A method for making a garment waist portion adjustable is provided by the present invention, by first forming at least one pair of folds from excess portions of the waist portion of a garment, moving the folds of each pair back toward one another and in contiguous engagement with the waist portion, and selectively affixing the pair of folds within a continuous range along the waist portion between each pair of folds.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An adjustable garment comprising:

a waist portion; and an adjustment device disposed along a surface of the waist portion, the adjustment device comprising:
a single central receiving element, opposing fastening elements positioned laterally along the waist portion at opposite sides of the central receiving element, respectively;

wherein the opposing fastening elements are spaced from the central receiving element and are configured to be selectively secured to the central receiving element to adjust an area defined by the waist portion.

2. The adjustable garment of claim 1, wherein the central receiving element and the opposing fastening elements include corresponding hook-and-loop materials.

3. The adjustable garment of claim 2, wherein the central receiving includes a plurality of hooks, and further wherein the opposing fastening elements each include a plurality of loops.

4. The adjustable garment of claim 2, wherein the central receiving element includes a plurality of loops, and further wherein the opposing fastening elements each include a plurality of hooks.

5. The adjustable garment of claim 1, wherein the opposing fastening elements are equidistantly spaced from the central receiving element.

6. The adjustable garment of claim 1, wherein the adjustment device is located on an outer surface of the waist portion.

7. The adjustable garment of claim 1, wherein the adjustment device is located on an inner surface of the waist portion.

8. The adjustable garment of claim 7, wherein the central receiving element includes a plurality of loops, and further wherein the opposing fastening elements each include a plurality of hooks.

9. The adjustable garment of claim 1, wherein only a single adjustment device is provided.

10. The adjustable garment of claim 1, the central receiving element is larger than either of the opposing fastening elements.

11. The adjustable garment of claim 1, wherein the adjustment device is located laterally along the waist portion adjacent a front-center portion of the garment as worn.

12. The adjustable garment of claim 1, wherein the adjustment device is located laterally along the waist portion adjacent a rear-center portion of the garment as worn.

13. The adjustable garment of claim 1, further comprising a belt configured to conceal the adjustment device upon final assembly.

14. An adjustable garment having a waist portion, the adjustable garment comprising:

an opposing pair of folds formed from excess material of the waist portion, the folds of each pair being folded back toward one another so as to reduce an area defined by the waist portion; and an adjustment device secured to the waist portion for selectively maintaining the opposing pair of folds, the adjustment device including:
a single central receiving element,
opposing fastening elements;

wherein the opposing fastening elements are spaced from the central receiving element and are configured to be selectively secured to the central receiving element.

15. The adjustable garment of claim 14, wherein the opposing fastening elements are equidistantly spaced.

16. The adjustable garment of claim 14, wherein the central receiving element and the opposing fastening elements are reciprocal hook-and-loop materials.

17. The adjustable garment of claim 14, wherein the garment includes only one adjustment device.

18. The adjustable garment of claim 14, wherein the adjustment device is located laterally along the waist portion adjacent a front-center portion of the garment as worn.

19. The adjustable garment of claim 1, wherein the central receiving element is centered relative to a front of the garment as worn.

20. The adjustable garment of claim 14, wherein the central receiving element is centered relative to a front of the garment as worn.

* * * * *